United States Patent [19]

Anderson et al.

[11] 4,401,160

[45] Aug. 30, 1983

[54] DOME-TYPE PACKOFF WELLHEAD

[75] Inventors: Glenn W. Anderson, Oildale; Stanley O. Hutchison, Bakersfield, both of Calif.

[73] Assignee: Chevron Research Company, San Francisco, Calif.

[21] Appl. No.: 284,747

[22] Filed: Jul. 20, 1981

[51] Int. Cl.[3] ..... E21B 33/03

[52] U.S. Cl. ..... 166/88; 166/84

[58] Field of Search ..... 166/88, 84, 89, 70, 166/77, 95, 303

[56] References Cited

U.S. PATENT DOCUMENTS

| | | | |
|---|---|---|---|
| 1,942,598 | 1/1934 | Hewgley | 166/95 |
| 2,186,139 | 1/1940 | Hild | 166/89 |
| 2,230,589 | 2/1941 | Driscoll | 166/89 |
| 2,771,956 | 11/1956 | Johnson | 166/88 |
| 3,478,822 | 11/1969 | Holbert, Jr. et al. | 166/88 |
| 4,071,085 | 1/1978 | Grable et al. | 166/88 |

*Primary Examiner*—Stephen J. Novosad
*Assistant Examiner*—Thuy M. Bui
*Attorney, Agent, or Firm*—G. W. Wasson; Edward J. Keeling

[57] ABSTRACT

A wellhead assembly for wells having tubing carrying hot fluids into or out of the well. The tubing is subject to elongation due to thermal expansion from a fixed portion within the well. The present wellhead accommodates the thermal elongation and provides a noncontacting connection to the tubing from outside the wellhead. The wellhead may also be constructed to accommodate concentric tubing for hot fluids to or from separate portions of the well.

16 Claims, 3 Drawing Figures

DOME-TYPE PACKOFF WELLHEAD

BACKGROUND OF THE INVENTION

In some underground petroleum reservoirs the petroleum within the reservoir is of such heavy gravity that even at the temperature of the underground formation the petroleum is immobile and will not flow to a producing well. It has been known to inject into those formations hot liquids or steams with the objective of raising the temperature of the formation to the point where the petroleum within the formation becomes heated to the point where it is mobile enough to be able to flow into a producing well bore.

A large body of technology has developed for the generation of hot fluids or steams at the earth surface and for the injection of those steams or fluids into the subsurface formations. Further, as the cost of energy has increased, more attention has been paid to the efficiency of generating and transporting the hot fluids from the surface to the subsurface formation with the objective of maximizing the input of heat into the formation and minimizing the loss of heat through the conductor carrying the hot fluids from the surface to the subsurface formation.

The subsurface formations that are now becoming targets for secondary recovery or steam stimulation techniques are deeper within the earth's formation than formations that were targets years ago and the chances for loss of thermal energy has substantially increased as the well depth increases. In some of the new target formations two different subsurface formations are candidates for the treatment with hot fluids and these different formations may be separated from each other by substantial distances. Further, each formation may be subject to different injection techniques requiring sometimes different temperatures and different pressures for the injection fluids.

It is usual in the above types of injection techniques that the conducting elements that are placed within the earth formation are of a metallic structure and are placed within the formation at the ambient temperatures of the atmosphere. In the usual case wells are drilled and cased and then steam injection tubing is run into the well and packers are placed between the tubing and the casing above (and sometimes below) the formation to be injected with hot fluids. Each of these operations is conducted at the ambient temperatures (surface or subsurface). After the subsurface well elements have been placed in the formation and the well is ready for steam injection, the wellhead is connected to a steam generator and the hot fluid is pumped down into the formation through the well tubing. As the subsurface well elements are heated to the elevated temperatures of the hot fluid they are subject to expansion and, if the well itself if not properly engineered to accommodate these expansions, the tubing may be damaged or buckled as the expansion forces are exerted between the fixed subsurface connections and the surface wellhead.

The present invention is directed to a wellhead configuration that is adapted to accommodate axial expansion of a hot fluid injection tubing at the wellhead. In accordance with one form of the present invention, a subsurface portion of the injection tubing is fixed in place in preparation for the injection of fluids into the formation while the upper end of the injection tubing may move in response to an axial thermal expansion. A second form of the invention accommodates two injection tubings while allowing one of the tubings to move at the wellhead to accommodate axial thermal expansion.

SUMMARY OF THE INVENTION

In accordance with the present invention a well is drilled into a subsurface formation containing heavy gravity petroleum crude and casing is placed into the well to prepare the formation for production. The casing is perforated or provided with slotted liners in those areas of the subsurface formation where production is expected and the formations are treated in many of several different manners to prepare the formations for injection of hot fluids or steam.

In accordance with the present invention a tubing string is passed down into the casing with its lower end aligned with the formation where the steam is to be injected. In the usual case, a packer is placed above the formations to be treated to insure that the steam that is injected down the tubing string is retained in the area where the heavy gravity crude is located. The tubing string is anchored in the packer and the packer prevents the injected hot fluids from flowing upwardly through the annulus between the casing and the tubing string.

Above the packer the tubing string is usually centralized within the casing to insure that there is an adequate stand off from the casing to prevent heat loss directly from the tubing string into the casing. The centralizers are preferably of a form of low heat conducting material to further improve the efficiency of the system. The tubing string below the packer may be provided with one or more areas of steam injection and the separate areas of steam injection may be separated from each other by steam deflectors and/or packers. Further, in accordance with the present invention, the tubing string above the packer is permitted to expand upwardly into the wellhead to relieve the packer of any axial strain and to avoid the need for an expansion joint between the packer and the wellhead. If two injection tubings are used in the well, one is provided with an expansion joint between the packer and the wellhead whereas the other expands toward the wellhead and the present invention accommodates that expansion.

DESCRIPTION OF DRAWINGS

The present invention relates to a wellhead assembly for accommodating axial expansion of a tubing string used in the injection of steam or hot fluid into a subsurface earth formation through a cased well. As shown in FIG. 1 the wellhead assembly 10 is mounted on a wellhead 12 which is the surface termination of casing 14 which has been placed into a well drilled into a subsurface earth formation 16. At the surface the casing is cemented at 18 to the earth formation; within the subsurface the casing 14 penetrates producing horizons 20 and 22 where the casing is provided with perforations 24 through which the desired hot fluids or steam are injected into the formation. Through the interior of the casing and laterally along the well a tubing string 26 is positioned so as to be centralized by centralizers 28 near the upper portions of the well bore and to be contained by a packer 30 some place above the producing horizons of interest. Below the packer the tubing string is provided with the necessary equipment to distribute the injected materials into the horizons of interest, one form of such equipment may include a steam deflector 32 and a suitable crossover apparatus 34 to separate portions of the injected fluids for injection into the formation 20 from the remaining portion of the fluid to be injected into the formation 22. Between the two producing formations, the tubing string may also support opposed packers 36 and 38 so as to isolate the injected fluids into the two separate producing formations. Many other varied subsurface configurations may be provided to accommodate the injection of fluids into the formation, the form shown here is only illustrative of such subsurface equipment and is here shown to illustrate that the tubing string 26 is fixed at some point within the subsurface by the packer 30 so that the tubing is fixed to the subsurface at the packer while above and below the packer the tubing may move axially in response to thermal expansion.

As the hot fluids are pumped through the tubing string, the tubing is subjected to higher temperatures and will inherently expand. In the apparatus of the present invention the expansion of the inner tubing upwardly from the packer is accommodated in the wellhead assembly 10 while the tubing is free to expand below the packer. In a dual string configuration, the outer tubing expansion above the packer is accommodated by a telescoping expansion joint while the inner tubing expansion is accommodated at the wellhead. Telescoping expansion joints are readily available from oil field equipment supply companies.

Figure 1:
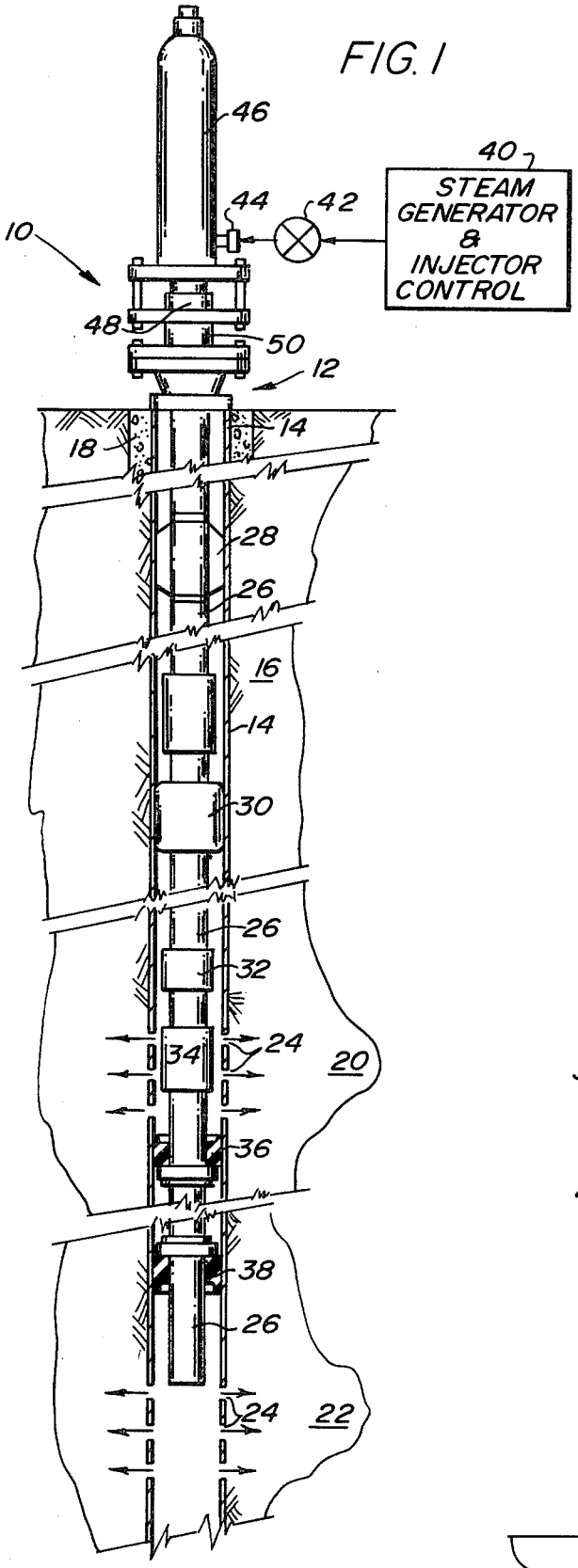
FIG. 1 is a cross-sectional view of a well bore penetrating a subsurface earth formation with a wellhead configuration in accordance with the present invention.

As illustrated in FIG. 1 a steam generator 40 is connected through valve 42 to a port 44 in a dome expansion chamber 46. The dome expansion chamber is connected by a series of flanges and connectors through a stuffing box 48 to a spool member 50 connected to a portion of the wellhead 12.

Figure 2:
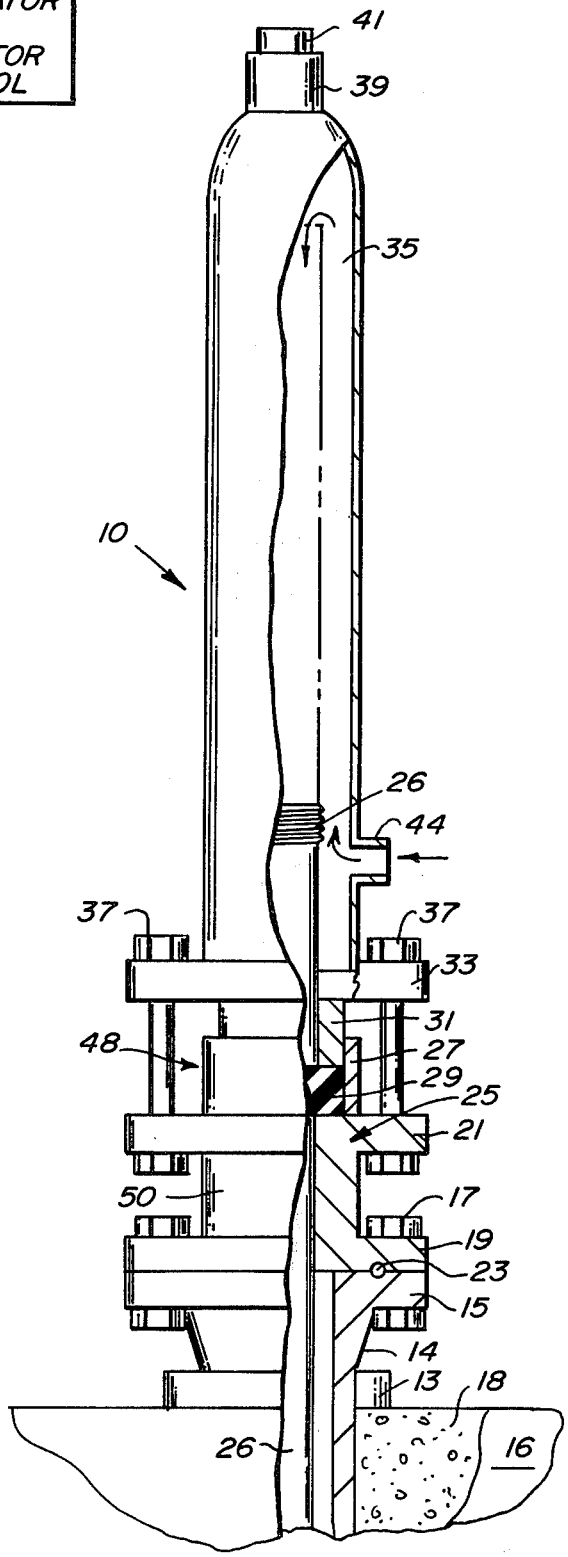
FIG. 2 is an assembly drawing partially in section showing a wellhead assembly for a single tubing string in accordance with the present invention.

FIG. 2 illustrates the wellhead assembly of the present invention with part of the elements shown in section. As here illustrated the wellhead 12 includes the terminal end of the well casing 14 cemented at 18 to the formation 16 with a conventional packing seal 13. The upper end of the casing 14 terminates in a flat wellhead surface at 15 providing a smooth working surface to which the upper ends of the packoff assembly may be attached.

In the specific form herein shown the spool member 50 having lower and upper flanges 19 and 21, respectively, is attached to the wellhead flange 15 by suitable bolts as at 17 with a sealing O-ring 23 between the flange 15 and the flange 19.

The outer surface of the upper flange 21 of the spool 50 is machined to provice an annular indentation 25 for accommodating the outer member 27 of packing gland 48. The stuffing box 27 accommodates a plurality of layers of packing gland material 29 and telescopes with a collar 31 to complete the packing gland. Collar 31 is fixed to or positioned by the lower surface of a flange 33 attached to the lower end of the expansion chamber 35 of the packoff assembly 10. The expansion chamber 46 may be welded to the upper surface of the flange 33 and the flanges 33 and 21 are secured together by bolts 37 which function to hold the expansion chamber 46 to the wellhead and to compress the packing glands to insure that the stuffing box 48 seals the annulus of the cased well from the pressure of injection materials or fluids inside the tubing string.

As illustrated in FIG. 2 the expansion chamber 46 permits axial movement of the tubing string 26 above the packing gland and within the expansion chamber. The expansion chamber is provided with a port at 44 for the connection to the steam generator as shown in FIG. 1. The upper end of the expansion chamber is provided with a workover port at 39 adapted with a plug 41 to seal the expansion chamber while providing axial access into the interior of the expansion chamber both for the injection of materials or for the entry into the interior of the tubing string.

The foregoing description of the parts of the assembly of the present invention should illustrate its function in a steam injection stimulation operation. In the usual well development procedures, the well is drilled and the casing is cemented into the formation, at least at the surface, to establish a working well for the injection of steam. After the tubing string has been positioned and the packer has been placed, steam may be generated at the surface and injected into the subsurface formation through the tubing to heat the subsurface crude and improve the mobility for production. As here illustrated the tubing string is fixed by the packer 30 in the subsurface formation and, as its temperatures rises and its length increases due to thermal expansion, the expansion of the tubing string is accommodated by the dome surface expansion chamber 35. The steam is injected into the tubing string by injection into the interior of the dome and through the interior to the free end of the tubing string. In that manner there is no requirement for a direct physical connection between the injection steam from the generator to the tubing string itself.

It should be understood that the length of the expansion chamber 35 is dependent upon the expected thermal expansion of the tubing string between the packer and the surface equipment. When the packer is near the surface and the expansion of the tubing string is minimal, the dome expansion chamber may be of minimal length. As the packer is placed further within the well bore and the length of the tubing string to the packer is increased, the expansion chamber must be made at least long enough to accommodate the entire expansion of the tubing string. With the tubing string free to expand in an axial direction up into an expansion chamber at the wellhead, the possibility of the tubing string being buckled by upward expansion forces is eliminated. The centralizers 28, as illustrated in FIG. 1, maintain the tubing string centralized within the well casing and the wellhead packoff assembly permits the tubing to expand into the expansion chamber.

Figure 3:
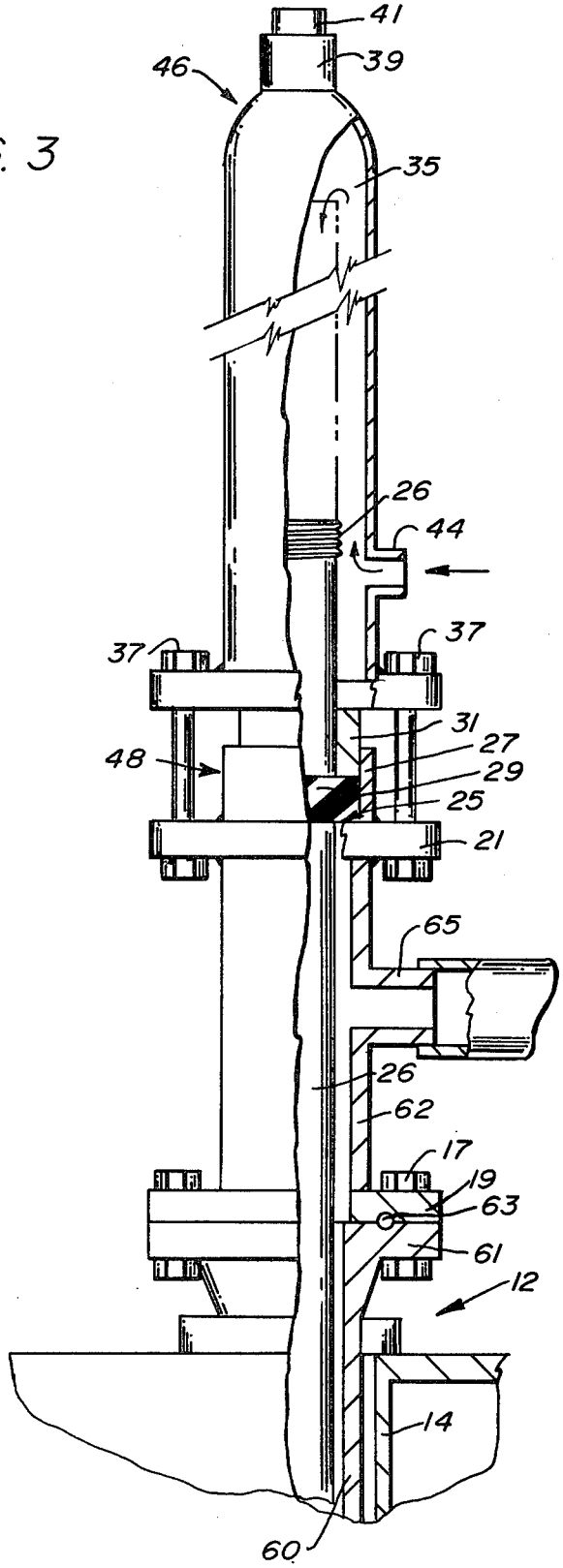
FIG. 3 is an assembly drawing partially in section showing a wellhead assembly for a dual string injection configuration.

FIG. 3 illustrates an alternative form of apparatus using the invention of the present invention. In the form there illustrated a pair of concentric injection tubing strings are shown. The inner tubing 26 is fixed to the casing 14 at the subsurface within the formation at a location where steam is to be injected into the formation. Expansion of the inner tubing 26 is accommodated in the expansion chamber 35 as described with respect to FIG. 2. A second tubing string 60 is concentric with the first tubing string 26 and is pressure and fluid separated from the first string.

As illustrated in FIG. 3, the second tubing string 60 is sealed at the wellhead 12 from the casing 14 to establish an annulus between the second, or outer tubing string and the inside of the casing 14. The string 60 is provided with a flange surface at 61 for connection to other wellhead equipment. As shown herein, a spool 62 is fixed by bolts 17 to flange 61 and sealed with an O-ring 63. The spool has an upper flange 21 and a lower flange 19 (similar to the spool shown in FIG. 2) and is provided with a port 65 providing access to the inside of the spool. The inner tubing string 26 passes through the inside of the spool and the outer tubing 60 establishing an annulus within the spool continuing to an annulus between the inner tubing and the outer tubing. Suitable centralizers, not shown, are preferably provided between the inner tubing and the outer tubing to function as the centralizer 28 shown in FIG. 2 between the tubing string 26 and the casing 14.

At the wellhead the packing gland 48 seals the inner tubing string 26 and expansion chamber 35 from the atmosphere and also seals the outer tubing string 60 and spool 62 from the inside of the inner tubing 26.

With the wellhead as illustrated in FIG. 3, two separated concentric tubing strings are provided with the inner string free to expand upwardly into the expansion chamber. When the outer tubing string is provided with an expansion joint between the wellhead and a packer at a subsurface location, the outer tubing is free to expand, in a telescoping manner, at the subsurface expansion joint. Both the inner and outer tubing are thus protected against the possibility of damage due to axial expansion as the tubing becomes heated with injection steam or hot fluid production.

While a certain preferred embodiment of the invention has been specifically disclosed, it should be understood that the invention is not limited thereto as many variations will be readily apparent to those skilled in the art and the invention is to be given its broadest possible interpretation within the terms of the following claims.

We claim:

1. In a well having tubing for carrying hot fluids into or out of said well, a wellhead tubing expansion assembly adapted to accommodate axial elongation of said tubing within said wellhead, said tubing being fixed at a downhole location within a well and being freely elongatable above said fixed location and through said wellhead, said assembly comprising:

a packing gland surrounding said tubing above said wellhead;

said packing gland having a first flange attachable to said wellhead and a second flange attachable to said first flange, said second flange having a collar portion cooperating with said first flange to establish said gland and a hollow portion surrounding said tubing and providing an expansion zone for said tubing; and noncontacting means in said hollow portion for providing a communication channel from outside said hollow portion to inside said tubing within said hollow portion.

2. The apparatus of claim 1 wherein said first flange of said packing gland is a flange on a spool member fixed to said wellhead.

3. The apparatus of claim 1 wherein said hollow portion of said second flange is a tubular member accessible to said tubing and providing said communication to said inside of said tubing without being connected thereto.

4. The apparatus of claim 3 with the addition of means permitting access to said tubular member to permit said tubing to be moved into and out of said wellhead through said hollow portion.

5. The apparatus of claim 3 wherein said hollow portion is a tubular dome fixed at one end to said second flange and sealed at its other end while providing internal elongation span for said tubing.

6. The apparatus of claim 1 wherein said tubing may elongate into said hollow portion in response to thermal elongation thereof.

7. The apparatus of claim 6 wherein the length of said hollow portion is determined by the maximum length of elongation of said tubing.

8. The apparatus of claim 1 wherein said noncontacting means in said hollow portion is a steam input port through said hollow portion providing access to the free end of said tubing within said hollow portion.

9. A wellhead configuration for use in a steam injection well for stimulating subsurface earth formations wherein the well includes:

a casing having a surface member accessible at said wellhead and subsurface portions fixed along its axial length to the subsurface formations; and a steam injection tubing string fixed to said casing at a subsurface location above said subsurface earth formation to be stimulated and below said surface member and establishing an annulus between said tubing and said casing;

said wellhead configuration comprising:

(a) a packoff means surrounding said tubing string fixed to an exposed surface of said surface member and providing pressure separation of said tubing string from said annulus, said packoff means permitting axial movement of said tubing through said means;

(b) a hollow member fixed to said packoff means and providing free internal movement space for said axial movement of said tubing through said packoff means and above said surface member; and (c) said hollow member being provided with port means for input of steam thereto so as to input said steam into said subsurface earth formations through tubing string.

10. The apparatus of claim 9 wherein said packoff means includes:

(a) a spool member having an upper flange and a lower flange, said lower flange being removably attached to said exposed surface of said surface member;

(b) a packing gland cooperating with said upper flange, said packing gland including a stuffing box, a compressible stuffing annulus within said box, and a collar portion movable within said stuffing box and against said stuffing annulus;

(c) a second flange, said second flange engaging said collar portion at the lower surface of said second flange and being fixed to said hollow member at the upper surface of said second flange;

(d) means for fixing said lower flange of said spool member to said exposed surface of said surface member; and (e) means for fixing said second flange to said upper flange of said spool member and for compressing said stuffing annulus between said stuffing box and said collar portion and against the outer surface of said tubing string.

11. The apparatus of claim 10 wherein:

(a) said hollow member is sealed against said upper surface of said second flange;

(b) the internal radial dimension of said hollow member is larger than the outer radial dimension of said tubing string; and (c) the axial length of said hollow member is longer than the expected axial elongation of said tubing string in response to temperature increase between ambient temperature and the temperature of said steam transported through said tubing string.

12. The apparatus of claim 10 wherein said spool member establishes a spool annulus around said steam injection tubing, said annulus being sealed from the inside of said tubing and from atmospheric pressure, and a port in said spool permitting access to said spool annulus whereby fluid communication may be had to said spool annulus independent of access to said inside of said tubing.

13. A wellhead tubing expansion assembly comprising:

(a) means fixed to said wellhead for sealing the well below said wellhead and for permitting axial movement of said tubing through said wellhead;

(b) an expansion chamber attached to said means fixed to said wellhead for accommodating said axial movement of said tubing through said wellhead; and (c) means for passing a fluid through said expansion chamber and into said tubing without direct connection to said tubing.

14. An assembly for a well penetrating an earth formation and having a wellhead fixed to the earth formation surface and the earth formation surrounding said well, said well having tubular members extending into said well, at least one of said tubular members having a portion thereof fixed within said well along a subsurface portion of said earth formation along said well and having a free end extending through said wellhead, said free end being subject to axial movement with respect to said wellhead from said fixed subsurface portion in response to conditions existing within said earth formation and/or within said tubular members, said assembly comprising:

(a) a means fixed to said wellhead for isolating said tubular members from each other and from said earth formation surface below said wellhead, said means permitting said axial movement of said free end of said at least one tubular member; and (b) port means on said means fixed to said wellhead providing fluid communication from outside said assembly to said free end of said at least one tubular member, said port means communicating with said free end of said at least one tubular member within said means permitting said axial movement without direct connection to said free end.

15. The assembly of claim 14 with the addition of a second port means at said wellhead providing fluid communication from outside said assembly to another of said tubular members and said subsurface portion of said earth formation independent of said communication with said at least one of said tubular members.

16. A wellhead configuration for use in a steam injection well for stimulating subsurface earth formations wherein the well includes:

a casing having a surface member accessible at said wellhead and subsurface portions fixed along its axial length to the subsurface formations; and at least a pair of concentric steam injection tubing strings passing through said wellhead and casing and to said subsurface earth formations;

the first of said steam injection tubing strings being fixed to said wellhead and being accessible at said wellhead and establishing a first annulus between said first tubing string and said casing;

the other of said pair of steam injection tubing strings being inside said first and fixed to said casing at a subsurface location above said subsurface earth formation to be stimulated and below said surface member and establishing a second annulus between said first tubing string and said second tubing string;

said wellhead configuration comprising:

(a) a spool member surrounding said first tubing string and having a first flange surface for cooperation with said surface member, said spool member providing a spool annulus surrounding said first tubing member, said spool annulus being connected to said first annulus, a port through said spool member for providing fluid access to and from said annulus, and a second flange surface on said spool member parallel to said first flange surface, said spool being so constructed as to seal said spool annulus and first annulus from atmospheric pressure at said wellhead;

(b) a packoff means surrounding said first tubing string and fixed to said second flange of said spool member and providing pressure separation of said second tubing string from said first annulus, said packoff means permitting axial movement of said tubing through said packoff means;

(c) a hollow member fixed to said packoff means and providing free internal movement space for said axial movement of said tubing; and (d) said hollow member being provided with port means for input of steam thereto so as to input said steam into said second tubing string.

* * * * *